US007950251B2

(12) United States Patent
Silvant

(10) Patent No.: US 7,950,251 B2
(45) Date of Patent: May 31, 2011

(54) PIECE OF JEWELLERY COMPRISING A MOBILE PART

(75) Inventor: Olivier Silvant, Macolin (CH)

(73) Assignee: The Swatch Group Management Services AG, Biel (CH)

( * ) Notice: Subject to any disclaimer, the term of this patent is extended or adjusted under 35 U.S.C. 154(b) by 781 days.

(21) Appl. No.: 11/773,765

(22) Filed: Jul. 5, 2007

(65) Prior Publication Data

US 2008/0006055 A1 Jan. 10, 2008

(30) Foreign Application Priority Data

Jul. 4, 2006 (EP) ..... 06116544

(51) Int. Cl.
*A44C 9/00* (2006.01)

(52) U.S. Cl. ..... 63/15.2; 63/15.1; 63/15.4

(58) Field of Classification Search ..... 63/15.1–15.7, 63/7–11, 15.8, 10
See application file for complete search history.

(56) References Cited

U.S. PATENT DOCUMENTS

| | | | | | |
|---|---|---|---|---|---|
| 289,912 | A | * | 12/1883 | Huleu | 63/41 |
| 1,565,651 | A | * | 12/1925 | Klass et al. | 63/15.7 |
| 1,830,929 | A | * | 11/1931 | Cohen | 63/15 |
| 1,936,604 | A | * | 11/1933 | Moldenhauer | 63/15 |
| 2,048,878 | A | * | 7/1936 | Moldenhauer | 63/15 |
| 2,182,876 | A | * | 12/1939 | Moldenhauer | 63/15 |
| 2,220,408 | A | * | 11/1940 | Kalina | 63/15 |
| 3,995,447 | A | * | 12/1976 | Levsunov | 63/1.12 |
| 4,854,133 | A | * | 8/1989 | Irwin | 63/15 |
| D309,276 | S | * | 7/1990 | Mejias | D11/26 |
| D309,277 | S | * | 7/1990 | Mejias | D11/27 |
| 5,228,317 | A | * | 7/1993 | Hendricks | 63/15.7 |
| 6,886,363 | B2 | * | 5/2005 | Hara | 63/15.4 |

FOREIGN PATENT DOCUMENTS

| | | |
|---|---|---|
| DE | 71 43 314 | 2/1972 |
| FR | 565 768 | 2/1924 |
| FR | 2 715 806 | 8/1995 |

OTHER PUBLICATIONS

European Search Report issued in corresponding application No. EP 06 11 6544, completed Nov. 23, 2006.

* cited by examiner

*Primary Examiner* — Jack W. Lavinder
(74) *Attorney, Agent, or Firm* — Griffin & Szipl, P.C.

(57) ABSTRACT

The piece of jewellery comprises at least two rings (2, 4) that can nest inside each other and have different diameters. These rings are assembled to each other so as to pivot relative to each other. The piece of jewellery can thus pass from a configuration wherein the rings are tilted to a configuration wherein they are nesting, such that the surface of the smaller ring (2) is concealed. The piece of jewellery further comprises indexing means (26, 11*c*) comprising a stud (26) secured to one of the rings (2, 4) and which is arranged for cooperating with the edge (30) of an elongated aperture (11*c*) made in another ring (4), so as to immobilize the rings selectively in a plurality of relative positions.

11 Claims, 5 Drawing Sheets

PIECE OF JEWELLERY COMPRISING A MOBILE PART

This application claims priority from European Patent Application No. 06116544.5 filed Jul. 4, 2006, the entire disclosure of which is incorporated herein by reference.

FIELD OF THE INVENTION

The present invention generally concerns pieces of jewellery of generally curved or annular shape, and which include a mobile part. The present invention concerns in particular finger rings and bracelets comprising a mobile part, and more specifically watch bracelets or wristbands comprising a mobile part.

BACKGROUND OF THE INVENTION

Pieces of jewellery of annular shape that comprise a mobile part are already known. In particular, U.S. Pat. Nos. 1,830,929 and 1,936,604 both disclose a finger ring that includes concentric rings of different diameters. These rings are assembled to each other via two pivots diametrically arranged opposite each other. These pivots are provided to allow the rings to pivot relative to each other between a tilted position, in which the outer surface of the smallest ring is visible, and a nesting position, in which the largest ring covers and conceals the outer surface of the smallest ring. These two finger rings are both further fitted with fastening means provided for holding them in the nesting position.

The pieces of jewellery disclosed in these first two prior art documents are not intended to be worn in the tilted position, or in other words, the open position. Even if the wearer of such a piece of jewellery decides to wear it in the open position, the piece of jewellery must be expected to close again, at least partially, very soon. Indeed, no means is provided for preventing this movement of the mobile part. Yet, it seems desirable to offer the wearer of a piece of jewellery provided with a mobile part, the possibility of wearing the same in several different positions if he so desires.

French Patent No. 2,715,806 discloses an annular shaped piece of jewellery which is intended to be worn in two different positions. This piece of jewellery comprises an annular shaped inner part and an outer part in the shape of a ring portion. The two parts are assembled by two coaxial pivots, arranged to allow the outer part to pivot. The piece of jewellery further comprises an elastic element, secured to one of the parts, and arranged for cooperating in abutment inside one or other of two housings made in the other part. This arrangement allows the outer part to be maintained selectively in a first position, wherein the two parts are fitted one inside the other, or in a second position wherein they are tilted.

The piece of jewellery disclosed in this third prior art document has certain drawbacks. Indeed, in order for the elastic element to have the possibility of cooperating in abutment inside a housing of the other part, the document teaches that the inner part and the outer part have to remain at least partially superposed. In such conditions, the width of the outer surface of the inner part is never entirely visible. Moreover, using a deformable element secured to one of the parts, capable of being compressed between the two parts, makes the piece of jewellery relatively complex to make.

SUMMARY OF THE INVENTION

It is an object of the present invention to provide a piece of jewellery comprising at least two rings, or ring portions, that can nest inside each other, capable of changing configuration by pivoting relative to each other about an axis common to both rings, and which does not suffer from the limitations that have just been mentioned. The present invention achieves this object in accordance with the invention by providing a piece of jewellery including at least one inner ring and one complete or partial outer ring, said rings being able to nest inside each other and the piece of jewellery including pivoting means arranged for varying the degree of nesting of the rings by pivoting said rings relative to each other about an axis common to the two rings, wherein the piece of jewellery further includes indexing means arranged for selectively maintaining the rings in a plurality of relative positions, said plurality of relative positions comprising at least a first position wherein the rings are nesting and a second position wherein the rings are tilted, said indexing means including a pin secured to a first ring and a first elongated aperture arranged in a second ring, said pin being engaged in said aperture and being provided to move transversely therein when said first ring is pivoted relative to said second ring, one edge of said aperture being provided for cooperating with the pin so as to selectively immobilise the pin in a plurality of relative positions.

According to the present invention, a pin secured to a first ring cooperates with one edge of an aperture in a second ring. One advantage of the present invention is that, unlike the deformable element of the prior art, the pin does not need a housing. In such conditions, the indexing means of the present invention can be both simpler and more compact, which, for example, means they can be arranged in proximity to the pivoting means.

BRIEF DESCRIPTION OF THE DRAWINGS

Other features and advantages of the present invention will appear upon reading the following description, given solely by way of non-limiting example with reference to the annexed drawings, in which.

DETAILED DESCRIPTION OF THE ILLUSTRATIVE EMBODIMENTS

Figure 1C:
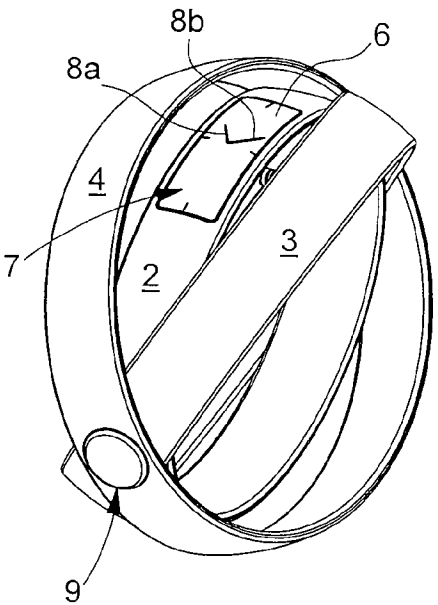
FIG. 1*c* is a perspective view of the wristwatch of FIGS. 1*a* and 1*b* with the outer ring and intermediate ring in the tilted position.
Figure 1B:
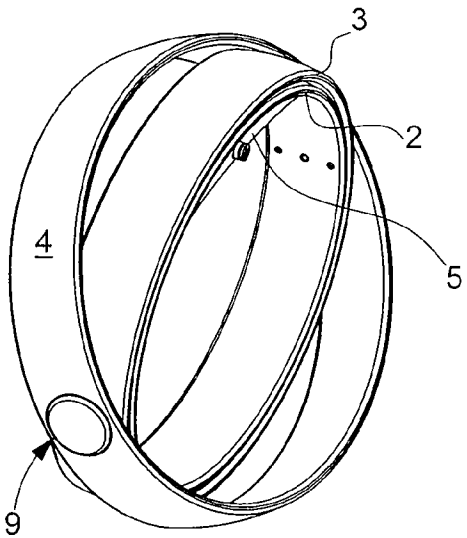
FIG. 1*b* is a perspective view of the wristwatch of FIG. 1*a* with the outer ring in the tilted position.
Figure 1A:
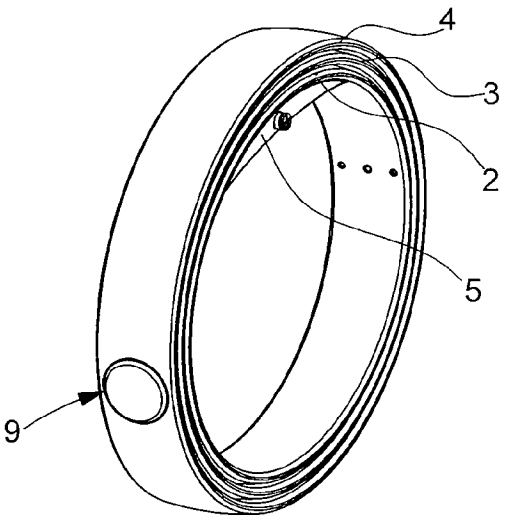
FIG. 1*a* is a perspective view of a wristwatch corresponding to a particular embodiment of a piece of jewellery according to the present invention.

The wristwatch shown in FIGS. 1*a*, 1*b* and 1*c* comprises three concentric rings able to nest within each other. In the following description, these rings will be called inner ring 2, intermediate ring 3 and outer ring 4. The three rings are assembled in two pivoting zones, only one of which (referenced 9) is visible in FIGS. 1*a*, 1*b* and 1*c*. The second pivoting zone between the rings is located diametrically opposite zone 9. The rings are provided for pivoting in relation to each other about a rotational axis passing through the aforementioned two pivoting zones. In the example shown in FIG. 1, a watch 5, comprising a dial 6 and hour and minute hands 8*a*, 8*b*, is integrated in inner ring 2, such that the watch crystal 7 is flush with the outer surface of said ring. The dial and time indication are thus visible through the outer surface of inner ring 2. Watch 5 occupies, on inner ring 2, a position substantially midway between the two pivoting zones 9.

It can be seen in FIG. 1*a* that the three rings 2, 3 and 4 are shown in the completely nested position. The rings are thus all three in the same orientation. In this configuration, intermediate ring 3 and outer ring 4 completely cover the outer surface of inner ring 2. Dial 6 and hands 8, forming the display of watch 5, are thus completely concealed.

FIG. 1*b* shows the same wristwatch with these rings in a second configuration. Outer ring 4 has thus been pivoted through 30° relative to the other two rings which are superposed. When the bracelet is worn with the rings in this second configuration, the appearance thereof is very different from that of the bracelet of FIG. 1*a*. However, the configuration shown in FIG. 1*b* still does not allow the time indication to be seen. It should be specified that the watch shown in this example is intended also to be worn in another configuration similar to that which has just been described, but wherein the ring tilted at 30° is intermediate ring 3, whereas the ring that conceals the time indication is outer ring 4.

Finally, in FIG. 1*c*, outer ring 4 and intermediate ring 3 are both tilted at 30° relative to inner ring 2. It can be seen that the outer ring and the intermediate ring occupy positions which are symmetrical relative to inner ring 2. It can also be seen that, in this configuration, the part of inner ring 2 that carries the watch is totally visible.

It will also be understood that various changes and improvements evident to those skilled in the art could be made to the embodiment that forms the subject of the present description, without departing from the scope of the present invention defined by the annexed claims. In particular, one could choose to use rings that do not close completely upon each other. There is known, particularly in the case of bracelets or necklaces, that such "incomplete" or "partial" rings, often have the advantage of being able to move apart slightly to allow them to be put on or taken off more easily. Moreover, one could choose to use a partial outer ring covering only one part of the circumference of the inner ring. One could also choose to use indexing means for maintaining the rings in more than two relative positions.

Figure 5C:
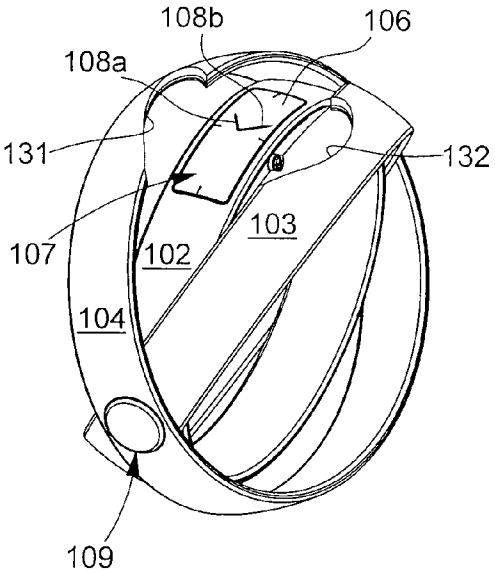
FIG. 5*c* is a perspective view of the wristwatch of FIGS. 5*a* and 5*b* with the outer ring and the intermediate ring in a second tilted configuration.
Figure 5B:
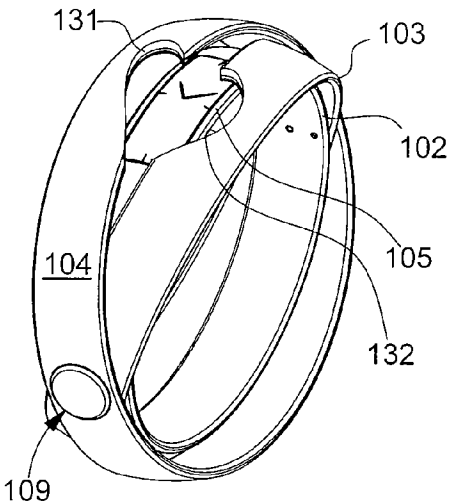
FIG. 5*b* is a perspective view of the wristwatch of FIG. 5*a* with the outer ring and the intermediate ring in a first tilted configuration.
Figure 5A:
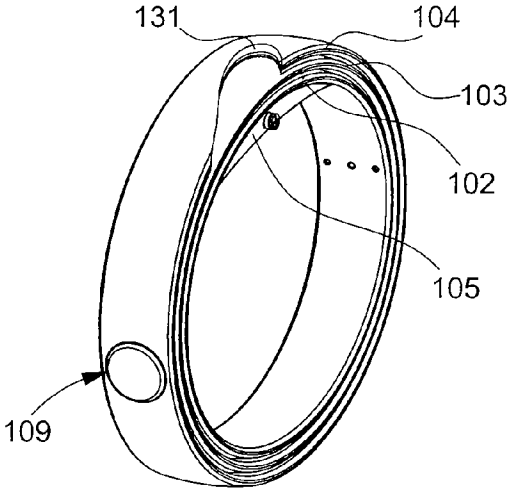
FIG. 5*a* is a perspective view of a wristwatch corresponding to a second embodiment of a piece of jewellery according to the present invention.

The rings could also have, for example, different widths or have a cut out portion giving the piece of jewellery a peculiar aesthetic appearance. By way of example, FIGS. 5*a*, 5*b* and 5*c* show a wristwatch that possesses this latter feature. As in the example of FIGS. 1*a*, 1*b* and 1*c*, the wristwatch of the present example comprises three rings 102, 103 and 104, which are shown in the nesting position in FIG. 5*a*. This Figure shows that outer ring 104 has a rounded cut out portion 131 in one of the sides thereof. This cut out portion could itself form a decorative design.

FIG. 5*b* shows the bracelet in a first tilted configuration wherein intermediate ring 103 and outer ring 104 occupy symmetrical positions tilted at 15° relative to the inner ring carrying the watch. It can be seen in this view that intermediate ring 103 also has a cut out portion (referenced 132) similar to that of the outer ring. It can also be seen that the cut out portions 131 and 132 have complementary shapes and that, in the configuration shown in FIG. 5*b*, they join together to form a decorative design. In the present example, the decorative design is a heart whose contours are outlined by the edges of the aperture between the rings 103 and 104. In this configuration, the watch dial is partially covered by each of rings 103, 104. Only the presence of the heart-shaped cut out portion 131, 132, makes it possible to read the time. Finally, in FIG. 5*c*, the bracelet is seen in a second tilted configuration wherein intermediate ring 103 and outer ring 104 occupy symmetrical tilted positions at 30° relative to the inner ring carrying the watch. This last configuration is similar to that already described in relation to FIG. 1*c*. The cut out portions 131 and 132 are too far away from each other here to join together to form a single design which could be obviously recognised.

Figure 2:
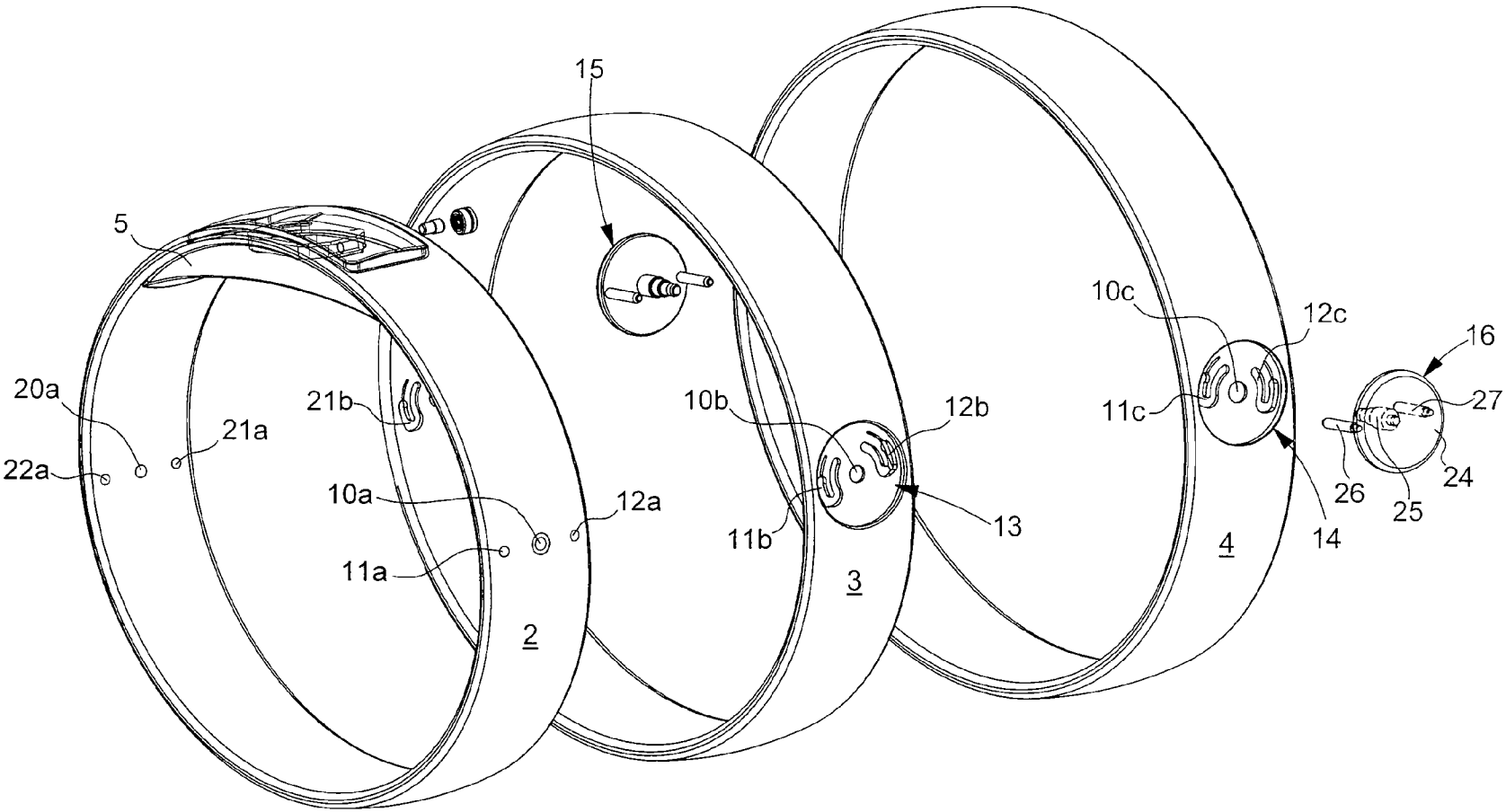
FIG. 2 is an exploded diagram of the bracelet of the watch of FIG. 1.

The exploded view of FIG. 2 shows the inner ring 2, intermediate ring 3 and outer ring 4 shown in FIGS. 1*a*, 1*b* and 1*c*. It can be seen in the Figure that each ring is pierced with three apertures at the place corresponding to pivoting zone 9. In the case of inner ring 2, these three apertures are circular holes. There is an axial aperture 10*a* and two lateral apertures 11*a* and 12*a*. Intermediate ring 3 also has three apertures, one axial aperture 10*b* and two lateral apertures 11*b* and 12*b*. However, as will be seen hereafter, these last two apertures are not circular, but of a more complex shape. It should also be noted that outer ring 4 has apertures 10*c*, 11*c* and 12*c* entirely similar to those of the intermediate ring.

FIG. 2 also shows a depressed portion 13 of generally circular shape arranged in the outer surface of intermediate ring 3, at pivoting zone 9. apertures 10*b*, 11*b* and 12*b* are arranged in the flat bottom of this depressed portion 13. A second entirely similar depressed portion 14 is arranged in the outer surface of outer ring 4. Apertures 10*c*, 11*c* and 12*c* of the outer ring are arranged in this depressed portion 14. Two other flat-bottomed depressed portions (not shown) are respectively arranged in intermediate ring 3 and outer ring 4 on the second pivoting region diametrically opposite region 9. FIG. 2 also shows circular apertures 20*a*, 21*a* and 22*a* which are arranged in inner ring 2 at the place corresponding to the second pivoting zone. It will also be understood that, three apertures symmetrical to apertures 10*b*, 11*b* and 12*b* are arranged in the second depressed portion of intermediate ring 3 (only one of these apertures referenced 21*b* is visible in the drawing). Finally, three other apertures (not shown), symmetrical to apertures 10*c*, 11*c* and 12*c* are arranged in outer ring 4.

Figure 3:
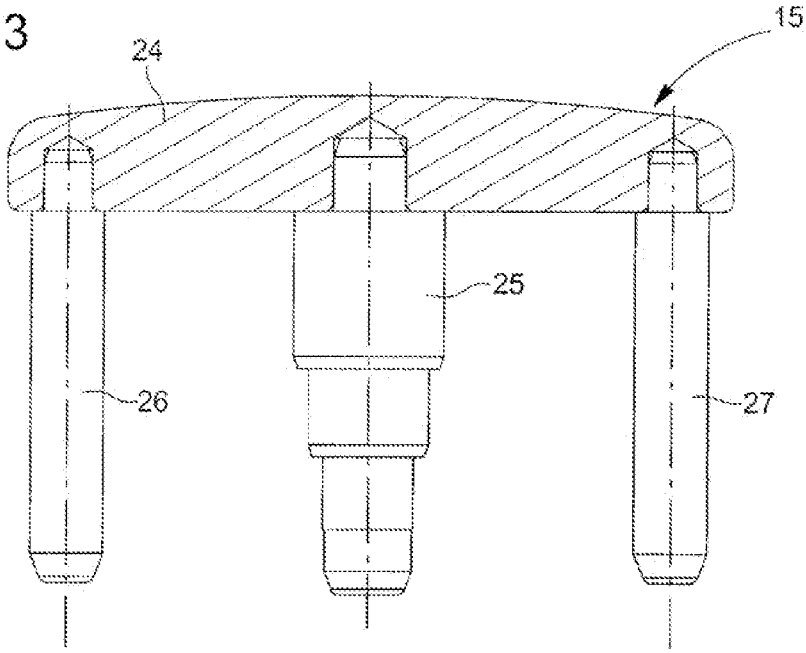
FIG. 3 is a cross-section of the two buttons for assembling the rings of the bracelet of FIG. 2.

Two identical buttons referenced 15 and 16 can also be seen in FIG. 2. FIG. 3 is a cross-section of one of these two buttons. It can be seen in FIGS. 2 and 3 that buttons 15 and 16 comprise a head 24 having the general shape of a disc and three substantially parallel studs 25, 26 and 27. Head 24 is sized to be able to be inserted in one of the circular depressed portions 14 which are arranged in the surface of outer ring 4. The central stud 25 of button 15 is provided for extending through circular apertures 10*c* and 10*b* of rings 4 and 3 and to be driven into aperture 10*a* of inner ring 2. Likewise, the central stud of button 16 is provided for passing through rings 4 and 3 and to have the end thereof driven into aperture 20*a* of ring 2. Outer ring 4 and intermediate ring 3 are provided for pivoting about the two central studs 25 of buttons 15 and 16. It will be clear that the two central studs have the function of an axis of rotation for outer ring 4 and intermediate ring 3. These central studs 25 thus form the pivoting means allowing the rings to pivot relative to each other. Moreover, since each of studs 25 is secured to inner ring 2 by one end, and ends in a head 24 at the other end, the three rings 2, 3 and 4 are kept assembled. In particular, mobile rings 3 and 4 are not liable to become detached from their axis of rotation. In light of the foregoing, central studs 25 of buttons 15 and 16 will be called the "coupling-bolts" in the following description.

In accordance with the views of FIGS. 2 and 3, buttons 15 and 16 also carry two lateral studs respectively referenced, 26 and 27 which are arranged, on either side of coupling-bolt 25. Lateral studs 26 and 27 of button 15 are respectively provided for passing through apertures 11*c* and 12*c* of outer ring 4 and through apertures 11*b* and 12*b* of intermediate ring 3 prior to being driven via the end thereof into apertures 11*a* and 12*a* of inner ring 2. Likewise, the two lateral studs of button 16 pass through rings 4 and 3, and the end thereof is driven into aperture 21*a* and into aperture 22*a* of ring 2. It will be clear from the foregoing that buttons 15 and 16 are secured to inner ring 2 in rotation.

Figure 4:
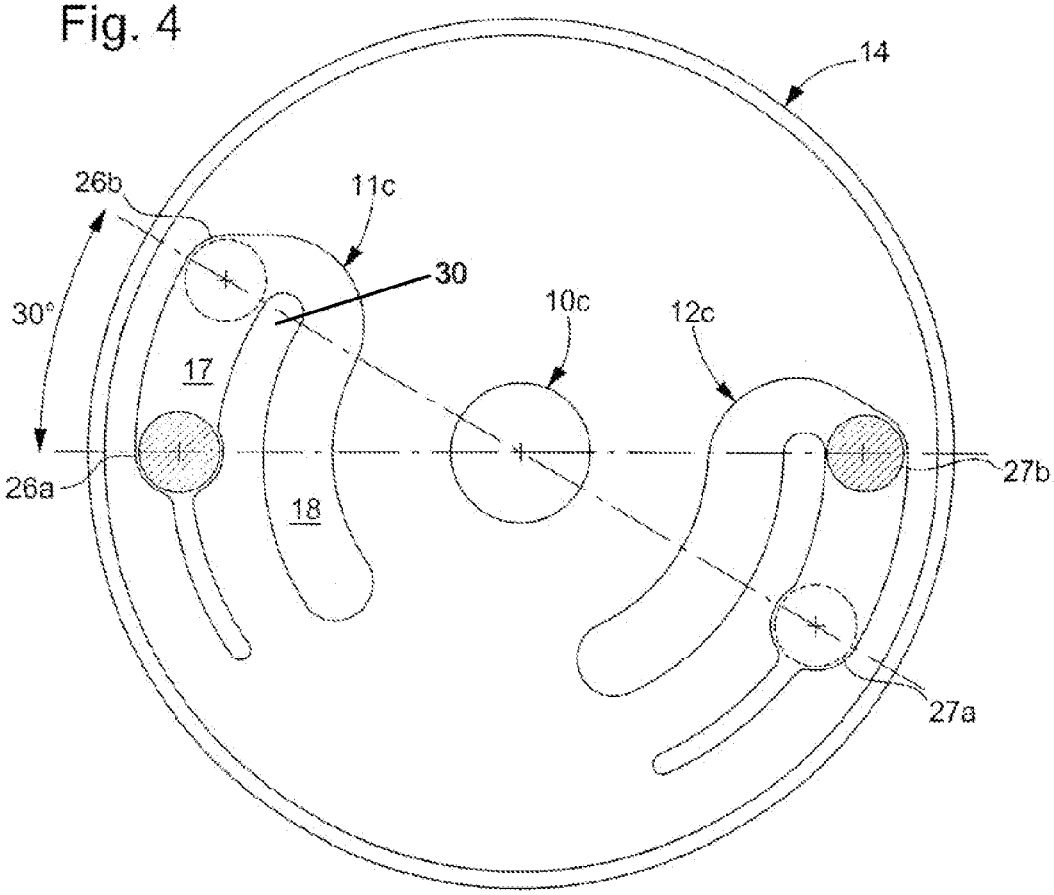
FIG. 4 is a top view of one of the two depressed portions which are arranged in the surface of the outer ring.

FIG. 4 is a top view of depressed portion 14, which is arranged in the surface of outer ring 4. It can be seen in FIG. 4 that, as already mentioned, the flat bottom of depressed portion 14 has three apertures 10*c*, 11*c* and 12*c*. The circular aperture 10*c* is arranged for receiving coupling-bolt 25, whereas the lateral apertures 11*c* and 12*c* are arranged for receiving lateral studs 26 and 27. In order to facilitate comprehension of the discussion that follows, FIG. 4 also shows lateral studs 26 and 27 engaged in apertures 11*c* and 12*c*.

Aperture 11*c*, like aperture 12*c*, extends substantially along a U-shape (an upside down U in FIG. 4). The two branches of the U (referenced 17 and 18) are parallel and extend in the arc of a circle. Lateral stud 26 penetrates frontally the branch 17 of aperture 11*c*. This branch 17 forms a slide way in which stud 26 can move transversely when outer ring 4 pivots relative to coupling-bolt 25. Thus, when outer ring 4 pivots through 30° in one direction or another, the stud moves between the two positions identified by the reference numbers 26*a* and 26*b*, which are separated by an arc of 30°. It can also be seen that branch 17 extends beyond position 26*a* via a narrowed end part. As a whole, the general U-shape of aperture 11*c* defines, in the material of outer ring 4, a long strip (referenced 30) which extends between the two arms of the U. This strip 30 is shaped so as to have certain radial elasticity, and it is arranged for cooperating with stud 26, a little like a jumper spring. The function of strip 30 is to maintain the stud, either in position 26*a*, or in position 26*b*.

Upon reading the foregoing, it will be clear that stud 26 only moves in the portion of slide way 11*c* which separates the two positions 26*a* and 26*b*. In particular, the other arm of the U (referenced 18) never receives stud 26. This latter aperture forms a slot that is arranged for providing the space necessary for the radial movement of strip spring 30.

As will be realised, aperture 12*c* is the symmetrical counterpart of aperture 11*c*. Aperture 12*c* forms a slide way arranged for receiving the later stud 27. Moreover, it should be noted that, when stud 26 is maintained by strip spring 30 in position 26*a*, stud 27 is retained in position 27*b*. Conversely, when stud 26 is retained in position 26*b*, stud 27 is in position 27*a*. This arrangement has the advantage of substantially equalising the force necessary for passing from one position to the other or vice versa. However, those skilled in the art will understand that, instead of being symmetrical, aperture 12*c* could, in a substantially equivalent manner, be rotated by 180° relative to aperture 11*c*. It would also be possible to use buttons 15 and 16 comprising only one stud 26 or 27. In such conditions, it would be possible also to remove the corresponding aperture (either aperture 11*c* or aperture 12).

FIG. 4 shows depressed portion 14 in which button 15 is inserted. However, it should be recalled that another depressed portion for receiving button 16 is arranged in a diametrically opposite position on outer ring 4. In this embodiment, the apertures made in the second depressed portion are entirely similar to those shown in FIG. 4. The only thing that distinguishes them is that they are the symmetrical image of the apertures of depressed portion 14 relative to the plane of inner ring 2. However, those skilled in the art will understand that another possible choice, for example, would be to only provide button 15 with lateral studs. In such case, button 16 only carries coupling-bolt 25 and the U-shaped apertures for receiving studs 26 and 27 of button 16 are no longer necessary.

The surface of intermediate ring 3 also has two depressed portions (one referenced 13 in FIG. 2), which carry apertures 10*b*, 11*b* and 12*b*, which are of similar shapes to the apertures made in outer ring 4. Indeed, like apertures 11*c* and 12*c* of the outer ring, apertures 11*b* and 12*b* are provided for cooperating with studs 26 and 27 for maintaining the intermediate ring in one of two angular positions separated by 30°. However, it was seen in relation to FIG. 1*c* that when outer ring 4 and intermediate ring 3 are tilted symmetrically relative to inner ring 2. For this reason, the shape of the apertures made in depressed portion 13 is symmetrical with the shape of that made in depressed portion 14.

Figure 6:
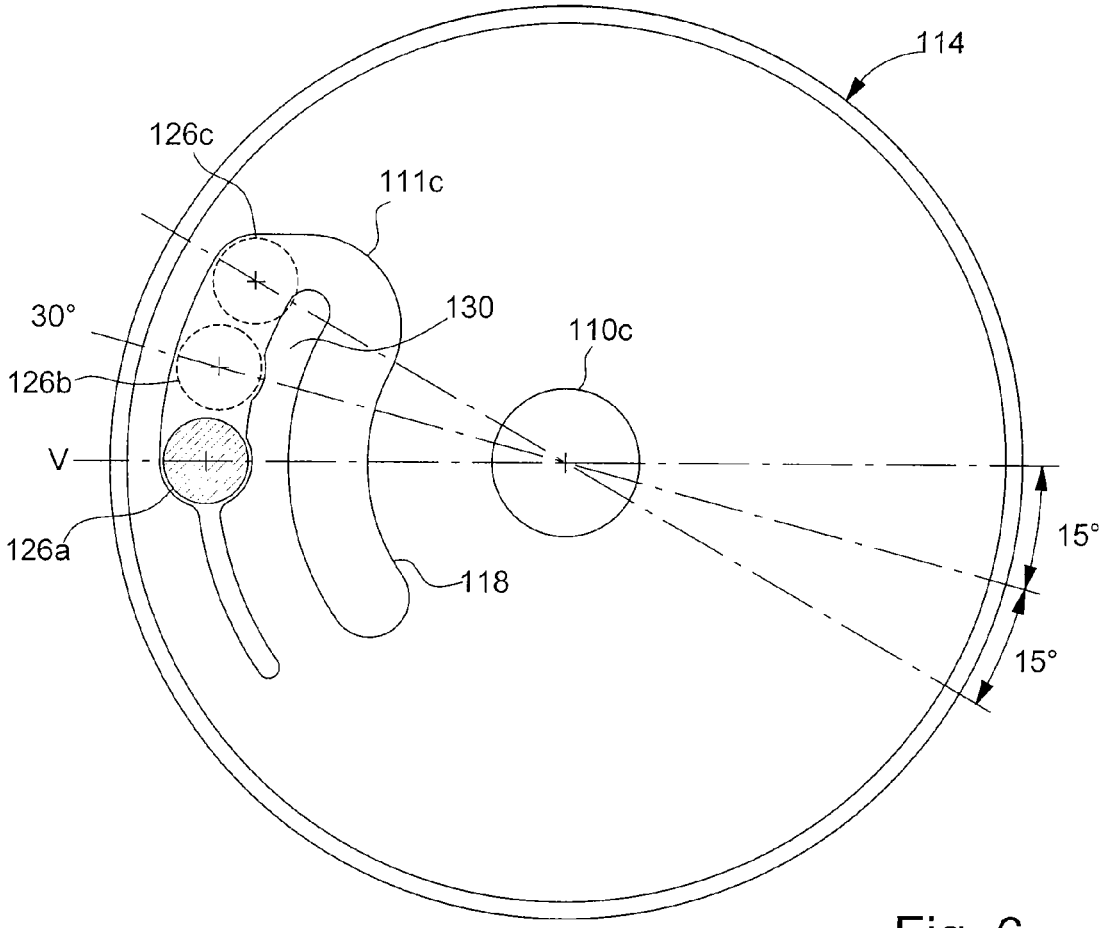
FIG. 6 is a top view of one of the two depressed portions which are arranged in the surface of the outer ring of the bracelet shown in FIGS. 5*a*, 5*b* and 5*c*.

FIG. 6 is a top view of one of the two depressed portions 114, which are arranged in the surface of outer ring 104 of the wristwatches shown in FIGS. 5*a*, 5*b* and 5*c*. It can be seen that, unlike the case of the example of FIG. 4, the flat bottom of depressed portion 114 has only two apertures 110*c* and 111*c*. The circular aperture 110*c* is provided for receiving a coupling-bolt 25, whereas the single lateral aperture 111*c* is provided for receiving a stud 26. As in the example of FIG. 4, aperture 111*c* extends substantially in a U-shape. As in the first example, the two branches of the U (referenced 117 and 118) are parallel and extend in the arc of a circle. Stud 26 penetrates branch 117 in a frontal manner and can slide transversely therein. The edges of branch 117 are shaped to able to maintain stud 26 selectively in three different positions (respectively referenced 126*a*, 126*b* and 126*c*). Two arcs of 15° separate positions 126*a*, 126*b* and 126*c* from each other. In accordance with the description given with reference to FIG. 4, the U-shape of aperture 111*c* defines in the material of outer ring 104 a long strip (referenced 130), which extends between the two arms of the U. The function of strip 130 is to maintain the pin selectively in one of positions 126*a*, 126*b* and 126*c*. When outer ring 104 (shown in FIGS. 5*a*, 5*b* and 5*c*) pivots by 15° from the superposed position thereof, pin 26 passes from position 126*a* to 126*b*. When the ring pivots by an additional 15° to be tilted by 30°, pin 26 passes from position 126*b* to 126*c*.

What is claimed is:

1. A piece of jewellery including:

(a) at least one inner ring;

(b) one complete or partial outer ring, wherein the rings are graduated in size so as to be able to nest inside each other;

(c) a pair of pivoting means arranged on an axis common to the two rings, wherein the pair of pivoting means varies the degree of nesting of the rings by pivoting the rings relative to each other about the axis; and (d) indexing means arranged for selectively maintaining the rings in a plurality of relative positions, wherein a plurality of the relative positions comprises at least a first position in which the rings are nesting and a second position in which the rings are tilted, wherein the indexing means includes a stud secured to a first ring and a first elongated aperture arranged in a second ring, wherein the stud is engaged in the aperture and provided to move transversely therein when the first ring is pivoted relative to the second ring, and wherein one edge of the aperture cooperates with the stud and thus selectively immobilises the stud in a plurality of the relative positions.

2. The piece of jewellery according to claim 1, wherein the first ring is the inner ring and in that the second ring is the outer ring.

3. The piece of jewellery according to claim 1, wherein the edge of said aperture is arranged for cooperating with the stud so as to selectively immobilise the stud in at least three relative positions.

4. A piece of jewellery including:

(a) at least one inner ring;

(b) one complete or partial outer ring, wherein the rings are able to nest inside each other;

(c) pivoting means arranged for varying the degree of nesting of the rings by pivoting the rings relative to each other about an axis common to the two rings; and (d) indexing means arranged for selectively maintaining the rings in a plurality of relative positions, wherein a plurality of the relative positions comprises at least a first position in which the rings are nesting and a second position in which the rings are tilted, wherein the indexing means includes a stud secured to a first ring and a first elongated aperture arranged in a second ring, wherein the stud is engaged in the aperture and provided to move transversely therein when the first ring is pivoted relative to the second ring, and wherein one edge of the aperture is provided for cooperating with the stud so as to selectively immobilise the stud in a plurality of the relative positions, and wherein the pivoting means includes a coupling bolt, the coupling bolt being secured to the first ring and arranged to engage in an axial aperture arranged in the second ring so as to allow the second ring to pivot about the coupling bolt.

5. The piece of jewellery according to claim 4, wherein the coupling bolt is arranged in proximity to the stud, and in that the coupling-bolt and the stud are joined at an end thereof by a head arranged for preventing the second ring from disengaging from the coupling-bolt.

6. A piece of jewellery including:

(a) at least one inner ring;

(b) one complete or partial outer ring, wherein the rings are able to nest inside each other;

(c) pivoting means arranged for varying the degree of nesting of the rings by pivoting the rings relative to each other about an axis common to the two rings; and (d) indexing means arranged for selectively maintaining the rings in a plurality of relative positions, wherein a plurality of the relative positions comprises at least a first position in which the rings are nesting and a second position in which the rings are tilted, wherein the indexing means includes a stud secured to a first ring and a first elongated aperture arranged in a second ring, wherein the stud is engaged in the aperture and provided to move transversely therein when the first ring is pivoted relative to the second ring, and wherein one edge of the aperture is provided for cooperating with the stud so as to selectively immobilise the stud in a plurality of the relative positions, and wherein the piece of jewellery further comprises an intermediate nesting ring, the diameter of which is intermediate between that of the outer ring and that of the inner ring.

7. The piece of jewellery according to claim 6, wherein one edge of the outer ring and one edge of the intermediate ring each comprises a cut out portion and in that in one of said plurality of relative positions, the cut out portions are opposite each other and form a decorative design.

8. The piece of jewellery according to claim 6, wherein in the second position, the outer ring and the intermediate ring are tilted substantially symmetrically relative to the inner ring.

9. A piece of jewellery including:

(a) at least one inner ring;

(b) one complete or partial outer ring, wherein the rings are able to nest inside each other;

(c) pivoting means arranged for varying the degree of nesting of the rings by pivoting the rings relative to each other about an axis common to the two rings; and (d) indexing means arranged for selectively maintaining the rings in a plurality of relative positions, wherein a plurality of the relative positions comprises at least a first position in which the rings are nesting and a second position in which the rings are tilted, wherein the indexing means includes a stud secured to a first ring and a first elongated aperture arranged in a second ring, wherein the stud is engaged in the aperture and provided to move transversely therein when the first ring is pivoted relative to the second ring, and wherein one edge of the aperture is provided for cooperating with the stud so as to selectively immobilise the stud in a plurality of the relative positions, wherein the first ring is the inner ring and in that the second ring is the outer ring, and wherein the piece of jewellery further includes an intermediate nesting ring, the diameter of which is intermediate between that of the outer ring and that of the inner ring and in that the indexing means further comprise a second elongated aperture arranged in the intermediate ring, the stud being engaged in the second aperture and arranged for moving transversely therein when the intermediate ring is pivoted relative to the inner ring, one edge of the aperture being arranged for cooperating with the stud so as to selectively immobilise the stud in a plurality of the relative positions.

10. The piece of jewellery according to claim 9, wherein one edge of the outer ring and one edge of the intermediate ring each comprises a cut out portion and in that in one said plurality of relative positions, the cut out portions are opposite each other and form a decorative design.

11. The piece of jewellery according to claim 9, wherein in the second position, the outer ring and the intermediate ring are tilted substantially symmetrically relative to the inner ring.

* * * * *